US008777349B2

(12) United States Patent
Tobita et al.

(10) Patent No.: US 8,777,349 B2
(45) Date of Patent: Jul. 15, 2014

(54) IMAGE FORMING APPARATUS INCLUDING RECORDING HEAD FOR EJECTING LIQUID DROPLETS

(75) Inventors: Satoru Tobita, Kanagawa (JP); Takashi Satou, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 193 days.

(21) Appl. No.: 13/421,112

(22) Filed: Mar. 15, 2012

(65) Prior Publication Data

US 2012/0236052 A1 Sep. 20, 2012

(30) Foreign Application Priority Data

Mar. 18, 2011 (JP) ..... 2011-060195

(51) Int. Cl.
*B41J 29/38* (2006.01)

(52) U.S. Cl.
USPC ..... 347/11

(58) Field of Classification Search
USPC ..... 347/10, 11
See application file for complete search history.

(56) References Cited

U.S. PATENT DOCUMENTS

| | | | | |
|---|---|---|---|---|
| 4,897,665 | A * | 1/1990 | Aoki | 347/10 |
| 7,478,898 | B2 | 1/2009 | Yamada et al. | |
| 7,494,210 | B2 | 2/2009 | Yamada et al. | |
| 7,651,203 | B2 | 1/2010 | Yamada et al. | |
| 7,654,652 | B2 | 2/2010 | Tobita et al. | |
| 7,744,197 | B2 | 6/2010 | Yamada et al. | |
| 7,871,141 | B2 * | 1/2011 | Teramae | 347/10 |
| 8,449,057 | B2 * | 5/2013 | Matsuo | 347/10 |
| 2003/0107617 | A1 | 6/2003 | Okuda et al. | |
| 2006/0125856 | A1 | 6/2006 | Kitami et al. | |
| 2010/0328409 | A1 | 12/2010 | Matsufuji et al. | |
| 2012/0081430 | A1 * | 4/2012 | Matsuo | 347/10 |
| 2012/0188300 | A1 * | 7/2012 | Zhang | 347/10 |

FOREIGN PATENT DOCUMENTS

| | | |
|---|---|---|
| CN | 101970235 A | 2/2011 |
| JP | 8-187852 | 7/1996 |
| JP | 11-254672 | 9/1999 |
| JP | 2001-260345 | 9/2001 |
| JP | 2003-94656 | 4/2003 |
| JP | 2003-118107 | 4/2003 |
| JP | 2004-142448 | 5/2004 |
| JP | 2005-246690 | 9/2005 |
| JP | 2008-183905 | 8/2008 |
| JP | 2009-34859 | 2/2009 |
| JP | 2009-132088 | 6/2009 |

OTHER PUBLICATIONS

Mar. 4, 2014 Chinese official action in connection with corresponding Chinese patent application No. 201210066943.5.

* cited by examiner

*Primary Examiner* — Julian Huffman
(74) *Attorney, Agent, or Firm* — Cooper & Dunham LLP

(57) ABSTRACT

An image forming apparatus includes a recording head and a driving waveform generator. The recording head has a nozzle, a liquid chamber, and a pressure generator. The driving waveform generator is connected to the pressure generator to generate and output a driving waveform including a plurality of driving pulses per driving cycle to eject a droplet from the nozzle. A last one of the driving pulses includes a first expansion waveform element, a first retaining waveform element, a first contraction waveform element, a second retaining waveform element, a second contraction waveform element, a third retaining waveform element, and a second expansion waveform element. The first contraction waveform element has a potential difference greater than a potential difference of the first expansion waveform element. The second contraction waveform element has a time period longer than a time period of the first contraction waveform element.

7 Claims, 10 Drawing Sheets

P71
P73
P74
P75
P76
P77
P78
104
201
201
301
302
301
302
301
301
301

IMAGE FORMING APPARATUS INCLUDING RECORDING HEAD FOR EJECTING LIQUID DROPLETS

CROSS-REFERENCE TO RELATED APPLICATION

This patent application is based on and claims priority pursuant to 35 U.S.C. §119 to Japanese Patent Application No. 2011-060195, filed on Mar. 18, 2011, in the Japan Patent Office, the entire disclosure of which is hereby incorporated by reference herein.

BACKGROUND

1. Technical Field

This disclosure relates to an image forming apparatus, and more specifically to an image forming apparatus including a recording head for ejecting liquid droplets.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid-droplet ejection head) for ejecting droplets of ink.

Such inkjet-type image forming apparatuses fall into two main types: a serial-type image forming apparatus that forms an image by ejecting droplets from the recording head while moving a carriage mounting the recording head in a main scanning direction, and a line-head-type image forming apparatus that forms an image by ejecting droplets from a linear-shaped recording head held stationary in the image forming apparatus.

Such an inkjet-type image forming apparatus may time-serially generate multiple driving pulses (ejection pulses) for ejecting droplets within one driving cycle to output a common driving waveform. For example, to form a relatively large dot, two or more driving pulses are selected to eject multiple droplets. Then, multiple droplets merge during flying and land on, e.g., a sheet of recording media to form the large dot on the sheet, thus allowing dots of different droplet sizes to be formed on the sheet. In addition, the image forming apparatus may incorporate a non-ejection pulse into the common driving waveform to drive the recording head without ejecting droplets. By selecting the non-ejection pulse, minute driving of the recording head can be performed to stably eject droplets.

To pressurize liquid in a liquid chamber to eject droplets of the liquid, for example, a driving pulse of a conventional driving waveform contracts the liquid chamber from an expanded state to eject liquid droplets, temporarily retains a contracted state, of the liquid chamber, further contracts the liquid chamber, and expands the liquid chamber.

In this regard, when a liquid droplet is ejected from a nozzle of the liquid ejection head, a droplet tail portion (hereinafter, "satellite") leading from the liquid droplet to a meniscus of liquid in the nozzle is created. The liquid droplet separates from the satellite and flies toward the sheet. The higher the viscosity of the liquid ejected from the nozzle, the longer the satellite. When the satellite separates from the meniscus of liquid in the nozzle, the satellite flies as a satellite droplet (by contrast, the above-described precedent flying liquid droplet is referred to as "main droplet").

To increase the print speed or print gap (between the nozzle and the recording media) in the image forming apparatus, it is preferable to shorten the length of satellites in ejecting the main droplets, minimize occurrences of satellite droplets, or prevent satellite droplets from landing on positions differing from the main droplets. In particular, in a case where multiple recording heads are arranged, if satellite droplets occur at different states between the recording heads, the color tone (e.g., brightness) of a resultant image may vary, thus affecting image quality. In addition, such different states of satellite droplets may result in, e.g., a reduced accuracy in reading a resultant bar code or a reduced image quality (e.g., blur) of characters.

BRIEF SUMMARY

In an aspect of this disclosure, there is provided an image forming apparatus including a recording head and a driving waveform generator. The recording head has a nozzle to eject a droplet of a liquid, a liquid chamber communicating with the nozzle, and a pressure generator to generate a pressure to pressurize the liquid in the liquid chamber. The driving waveform generator is connected to the pressure generator to generate and output a driving waveform including a plurality of driving pulses per driving cycle to eject the droplet from the nozzle. A last one of the plurality of driving pulses includes a first expansion waveform element, a first retaining waveform element, a first contraction waveform element, a second retaining waveform element, a second contraction waveform element, a third retaining waveform element, and a second expansion waveform element. The first expansion waveform element expands the liquid chamber. The first retaining waveform element retains a first expanded state of the liquid chamber created by the first expansion waveform element. The first contraction waveform element contracts the liquid chamber from the first expanded state of the liquid chamber retained by the first contraction waveform element to eject the droplet from the nozzle. The second retaining waveform element retains a first contracted state of the liquid chamber created by the first contraction waveform element. The second contraction waveform element further contracts the liquid chamber from the first contracted state of the liquid chamber retained by the second retaining waveform element. The third retaining waveform element retains a second contracted state of the liquid chamber created by the second contraction waveform element. The second expansion waveform element expands the liquid chamber from the second contracted state retained by the third retaining waveform element to a state prior to application of the first expansion waveform element. The first contraction waveform element has a potential difference greater than a potential difference of the first expansion waveform element. The second contraction waveform element has a time period longer than a time period of the first contraction waveform element.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
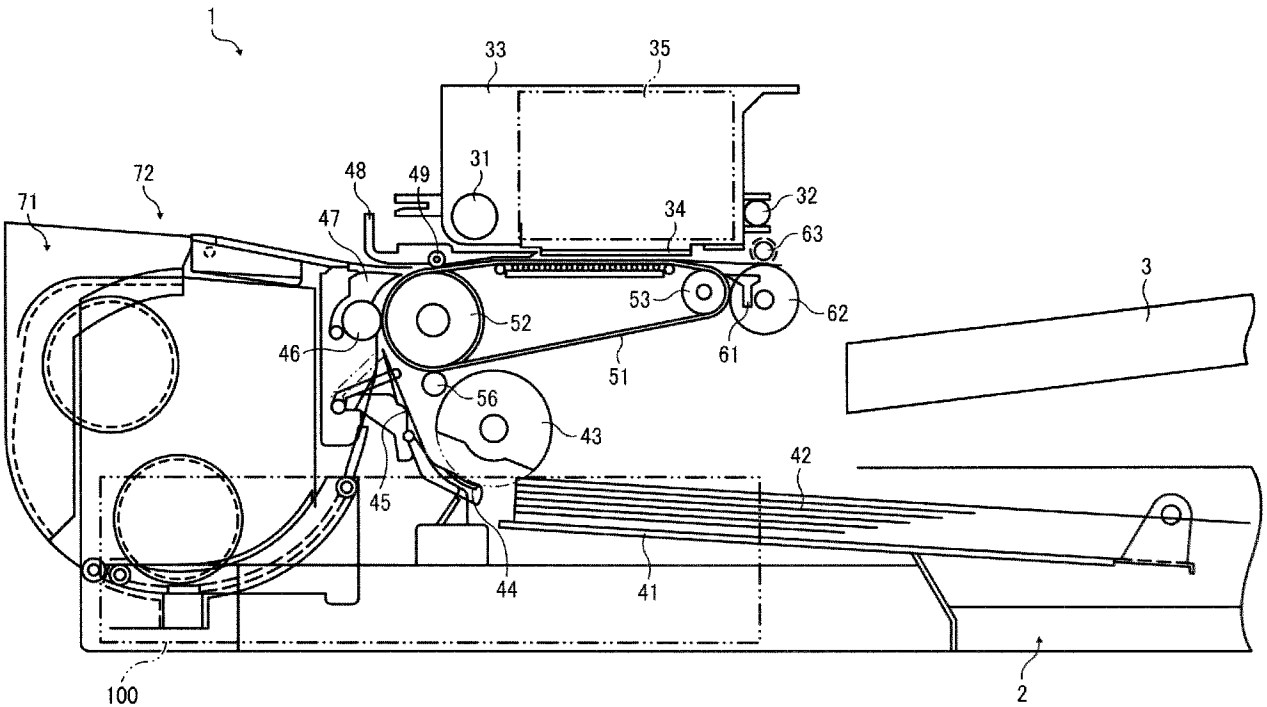
FIG. 1 is a schematic side view of a mechanical section of an image forming apparatus according to an exemplary embodiment of the present disclosure.

The accompanying drawings are intended to depict exemplary embodiments of the present disclosure and should not be interpreted to limit the scope thereof The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium (in other words, the term "image formation" includes only causing liquid droplets to land on the medium). The term "ink" as used herein is not limited to "ink" in a narrow sense and includes any types of liquid useable for image formation, such as a recording liquid, a fixing solution, a DNA sample, and a pattern material. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, or a recording sheet. The term "image" used herein is not limited to a two-dimensional image and includes, for example, an image applied to a three dimensional object and a three dimensional object itself formed as a three-dimensionally molded image.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment of this disclosure is described with reference to FIGS. 1 and 2.

FIG. 1 is a side view of an entire configuration of the image forming apparatus. FIG. 2 is a plan view of the image forming apparatus. In this exemplary embodiment, the image forming apparatus is described as a serial-type inkjet recording apparatus. It is to be noted that the image forming apparatus is not limited to such a serial-type inkjet recording apparatus and may be any other type image forming apparatus.

Figure 2:
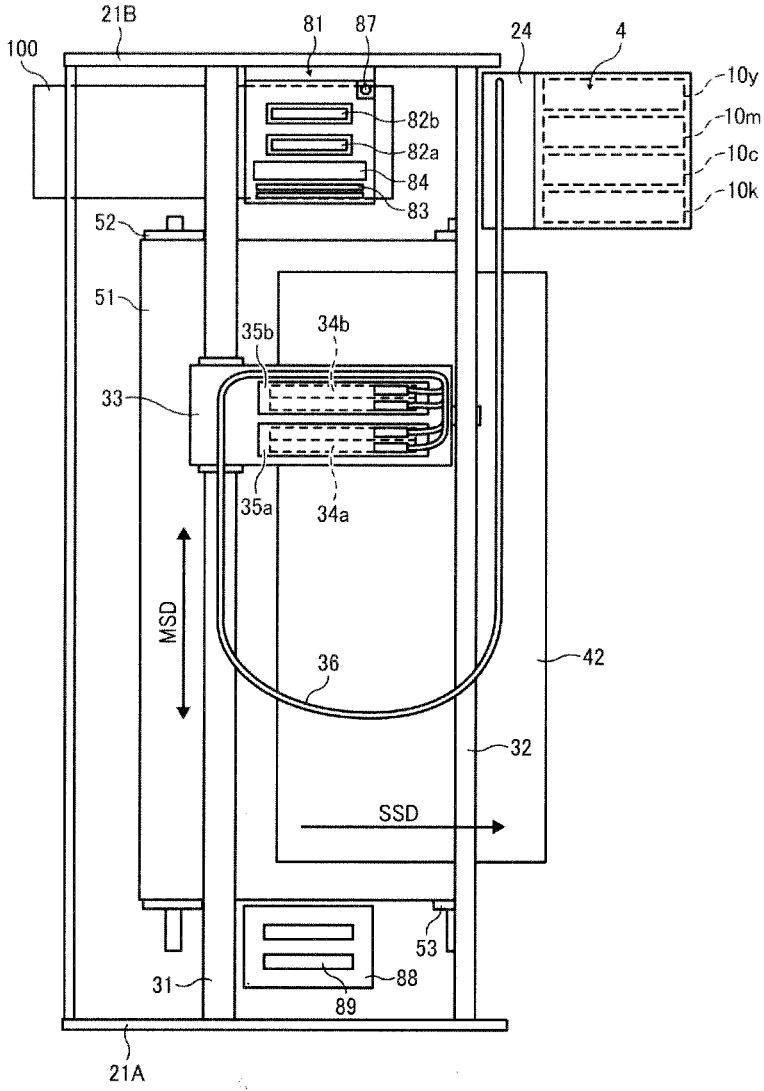
FIG. 2 is a plan view of the mechanical section of the image forming apparatus illustrated in FIG. 1.

In the image forming apparatus, a carriage 33 is supported by a main guide rod 31 and a sub guide rod 32 so as to be slidable in a direction (main scan direction) indicated by a double arrow MSD in FIG. 2. The main guide rod 31 and the sub guide rod 32 serving as guide members extend between a left-side plate 21A and a right-side plate 21RB standing on a main unit 1. The carriage 33 is reciprocally moved in the main scan direction by a main scanning motor and a timing belt.

On the carriage 33 are mounted recording heads 34*a* and 34*b* (collectively referred to as "recording heads 34" unless distinguished) formed with liquid ejection heads for ejecting droplets of yellow (Y), cyan (C), magenta (M), and black (K) inks. The recording heads 34*a* and 34*b* are mounted on the carriage 33 so that multiple rows of nozzles are arranged in a direction (sub-scanning direction) perpendicular to the main scanning direction and ink droplets are ejected downward from the nozzles.

For example, each of the recording heads 34 has two nozzle rows. In such a case, for example, one of the nozzle rows of the recording head 34*a* ejects droplets of black (K) ink and the other ejects droplets of cyan (C) ink. In addition, one of the nozzles rows of the recording head 34*b* ejects droplets of magenta (M) ink and the other ejects droplets of yellow (Y) ink. It is to be noted that the configuration of the recording heads 34 is not limited to the above-described configuration but, for example, the recording head 34 may have nozzle rows dedicated for respective color inks in a single nozzle face.

On the carriage 33 are mounted head tanks 35*a* and 35*b* (collectively referred to as "head tanks 35" unless distinguished) serving as a second ink supply unit for supplying the corresponding color inks to the respective nozzle rows of the recording heads 34. A pump unit 24 supplies (replenishes) the corresponding color inks from ink cartridges (main tanks) 10Y, 10M, 10C, and 10K removably mountable in a cartridge mount portion 4 to the head tanks 35 via ink supply tubes 36 dedicated for the respective color inks.

The image forming apparatus further includes a sheet feed section to feed sheets 42 stacked on a sheet stack portion (platen) 41 of a sheet feed tray 2. The sheet feed section further includes a sheet feed roller 43 of, e.g., semi-circular shape that separates the sheets 42 from the sheet stack portion 41 and feeds the sheets 42 sheet by sheet and a separation pad 44 that is disposed facing the sheet feed roller 43. The separation pad 44 is made of a material of a high friction coefficient and biased (urged) toward the sheet feed roller 43.

To feed the sheets 42 from the sheet feed section to a position below the recording heads 34, the image forming apparatus includes a first guide member 45 that guides the sheet 42, a counter roller 46, a conveyance guide member 47, a press member 48 including a front-end press roller 49, and a conveyance belt 51 that conveys the sheet 42 to a position opposing the recording heads 34 with the sheet 42 electrostatically attracted thereon.

The conveyance belt 51 is an endless belt that is looped between a conveyance roller 52 and a tension roller 53 so as to circulate in a belt conveyance direction (sub-scanning direction). A charging roller 56 serving as a charging device is provided to charge the surface of the conveyance belt 51. The charging roller 56 is disposed so as to contact the surface of the conveyance belt 51 and rotate with the circulation of the conveyance belt 51. The conveyance roller 51 is rotated by a sub-scanning motor via a timing roller, so that the conveyance belt 51 circulates in the sub-scanning direction indicated by an arrow "SSD" of FIG. 2.

The image forming apparatus further includes a sheet output section that outputs the sheet 42 on which an image has been formed by the recording heads 34. The sheet output section includes a separation claw 61 that separates the sheet 42 from the conveyance belt 51, a first output roller 62, a second output roller 63, and a sheet output tray 3 disposed below the first output roller 62.

A duplex unit 71 is detachably mounted on a rear portion of the main unit 1. When the conveyance belt 71 rotates in reverse to return the sheet 42, the duplex unit 71 receives the sheet 42. Then the duplex unit 71 turns the sheet 42 upside down to feed the sheet 42 between the counter roller 46 and the conveyance belt 51. A manual-feed tray 72 is formed at the top face of the duplex unit 71.

A maintenance unit 81 is disposed at a non-printing area (non-recording area) that is located on one end in the main-scanning direction of the carriage 33. The maintenance unit 81 maintains and recovers nozzle conditions of the recording heads 34. The maintenance unit 81 includes caps 82*a* and 82*b* (hereinafter collectively referred to as "caps 82" unless distinguished) to cover the nozzle faces of the recording heads 34, a wiper member (wiper blade) 83 to wipe the nozzle faces of the recording heads 34, a first droplet receptacle 84 to receive ink droplets discharged to remove increased-viscosity ink during maintenance ejection, and a carriage lock 87 to lock the carriage 33. Below the maintenance unit 81, a waste liquid tank 100 is removably mounted to the main unit 1 to store waste ink or liquid generated by the maintenance and recovery operation.

A second droplet receptacle 88 is disposed at a non-recording area on the other end in the main-scanning direction of the carriage 33. The second droplet receptacle 88 receives ink droplets that are discharged to remove increased-viscosity ink during, e.g., recording (image forming) operation. The second droplet receptacle 88 has openings 89 arranged in parallel with the rows of nozzles of the recording heads 134.

In the image forming apparatus having the above-described configuration, the sheet 42 is separated sheet by sheet from the sheet feed tray 2, fed in a substantially vertically upward direction, guided along the first guide member 45, and conveyed between the conveyance belt 51 and the counter roller 46. Further, the front tip of the sheet 42 is guided with a conveyance guide 37 and pressed against the conveyance belt 51 by the front-end press roller 49 to turn the traveling direction of the sheet 42 by approximately 90°.

At this time, voltages are applied to the charging roller 56 so as to alternately repeat positive and negative outputs, and as a result, the conveyance belt 51 is charged with alternately charged voltage patterns. When the sheet 42 is fed onto the conveyance belt 51 alternately charged with positive and negative charges, the sheet 42 is attracted on the conveyance belt 51 and conveyed in the sub-scanning direction by circulation of the conveyance belt 51.

By driving the recording heads 34 in response to image signals while moving the carriage 33, ink droplets are ejected onto the sheet 42, which is stopped below the recording heads 34, to form one band of a desired image. Then, the sheet 42 is fed by a certain distance to prepare for the next operation to record another band of the image. Receiving a signal indicating that the image has been recorded or the rear end of the sheet 42 has arrived at the recording area, the recording heads 34 finish the recording operation and the sheet 42 is output to the sheet output tray 3.

To perform maintenance-and-recovery operation of the nozzles of the recording heads 34, the carriage 33 is moved to a home position at which the carriage 33 opposes the maintenance unit 81. Then, maintenance-and-recovery operation, such as nozzle suctioning operation for suctioning ink from nozzles with the nozzle face of the recording heads 34 covered with the caps 82 and/or maintenance ejection for ejecting droplets of ink not contributed to image formation, is performed, thus allowing image formation with stable droplet ejection.

Next, an example of liquid ejection heads forming the recording heads 34 is described with reference to FIG. 3.

Figure 3:
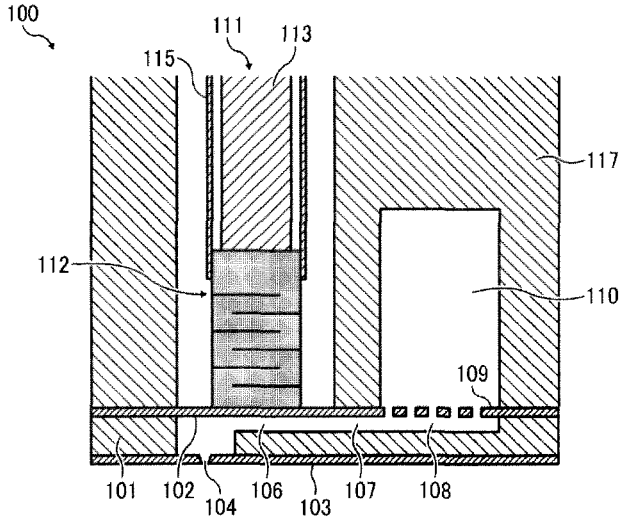
FIG. 3 is a cross-sectional view of a liquid ejection head of the image forming apparatus cut along a longitudinal direction of a liquid chamber.

FIG. 3 is a cross-sectional view of a liquid ejection head 100 cut along a longitudinal direction of a liquid chamber.

In the liquid ejection head 100, a channel plate 101, a diaphragm member 102, and a nozzle plate 103 are joined together to form liquid chambers 106, fluid resistance portions 107, and liquid introducing portions 108. In FIG. 3, a liquid chamber 106 communicates with a nozzle 104, and a fluid resistance portion 107 and a liquid introducing portion 108 supply liquid to the liquid chamber 106. A common chamber 110 is formed in a frame member 117, and a filter 109 is formed in the diaphragm member 102. The liquid (ink) is introduced from the common chamber 110 to the liquid introducing portion 108 via the filter 109, and supplied from the liquid introducing portion 108 to the liquid chamber 106 via the fluid resistance portion 107.

The channel plate 101 is formed by anisotropically etching a silicon substrate so as to have openings and channels, such as the liquid chambers 106, the fluid resistance portions 107, and the liquid introducing portions 108. The diaphragm member 102 is a wall member forming a wall face of each of the liquid chambers 106, the fluid resistance portions 107, and the liquid introducing portions 108. In addition, as described above, the filters 109 are formed in the diaphragm member 102.

In FIG. 3, a laminated piezoelectric member 112 is bonded to a face of the diaphragm member 102 opposite a face facing the liquid chamber 106. The laminated piezoelectric member 112 is a pillar-shaped electromechanical transducer serving as a driving element (actuator device, pressure generator) to generate energy for applying pressure to ink in the liquid chamber 106 to eject liquid droplets from the nozzle 104. One end of the piezoelectric member 112 is joined to the base member 113, and flexible printed cables (FPCs) 115 are connected to the piezoelectric member 112 to transmit driving waveform. Thus, a piezoelectric actuator 111 is formed.

Figure 4:
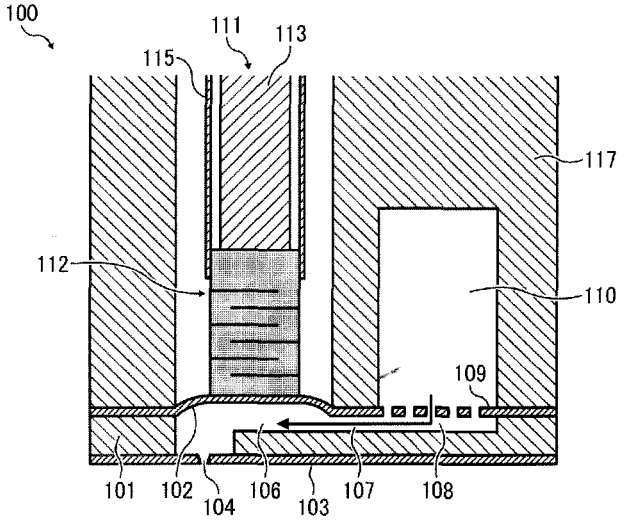
FIG. 4 is a cross-sectional view of the liquid ejection head during expansion.
Figure 5:
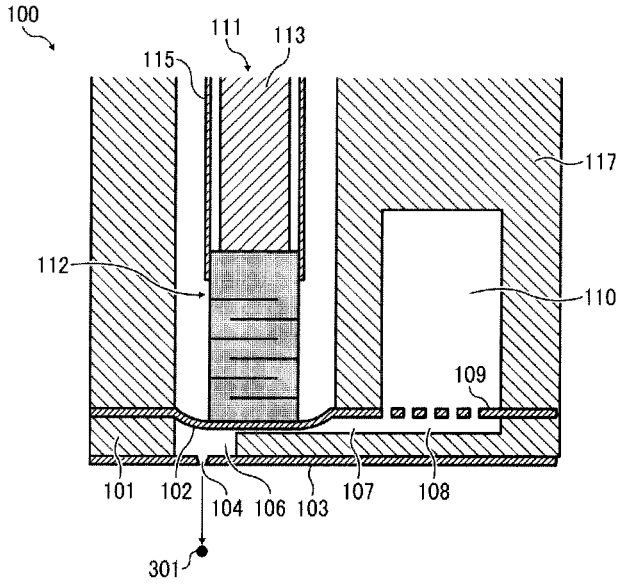
FIG. 5 is a cross-sectional view of the liquid ejection head during contraction.

In the liquid ejection head 100 having the above-described configuration, for example, as illustrated in FIG. 4, by reducing the voltage applied to the piezoelectric member 112 below a reference potential Ve, the piezoelectric member 112 contracts to deform the diaphragm member 102. As a result, the volume of the liquid chamber 106 expands, thus causing ink to flow into the liquid chamber 106. Then, as illustrated in FIG. 5, by increasing the voltage applied to the piezoelectric member 112 above the reference potential Ve, the piezoelectric member 112 extends in the laminated direction to deform the diaphragm member 102 toward the nozzle 104, thus contracting the volume of the liquid chamber 106. As a result, ink in the liquid chamber 106 is pressurized, thus ejecting a liquid droplet 301 from the nozzle 104.

Then, by returning the voltage applied to the piezoelectric member 112 to the reference potential, the diaphragm member 102 returns to its original position (restores its original shape). As a result, the liquid chamber 106 expands and a negative pressure occurs in the liquid chamber 106, thus replenishing ink from the common chamber 110 to the liquid chamber 106. After vibration of a meniscus surface of the nozzle 104 decays to a stable state, the process shifts to an operation for the next droplet ejection.

Next, a controller of the image forming apparatus is described with reference to FIG. 6.

Figure 6:
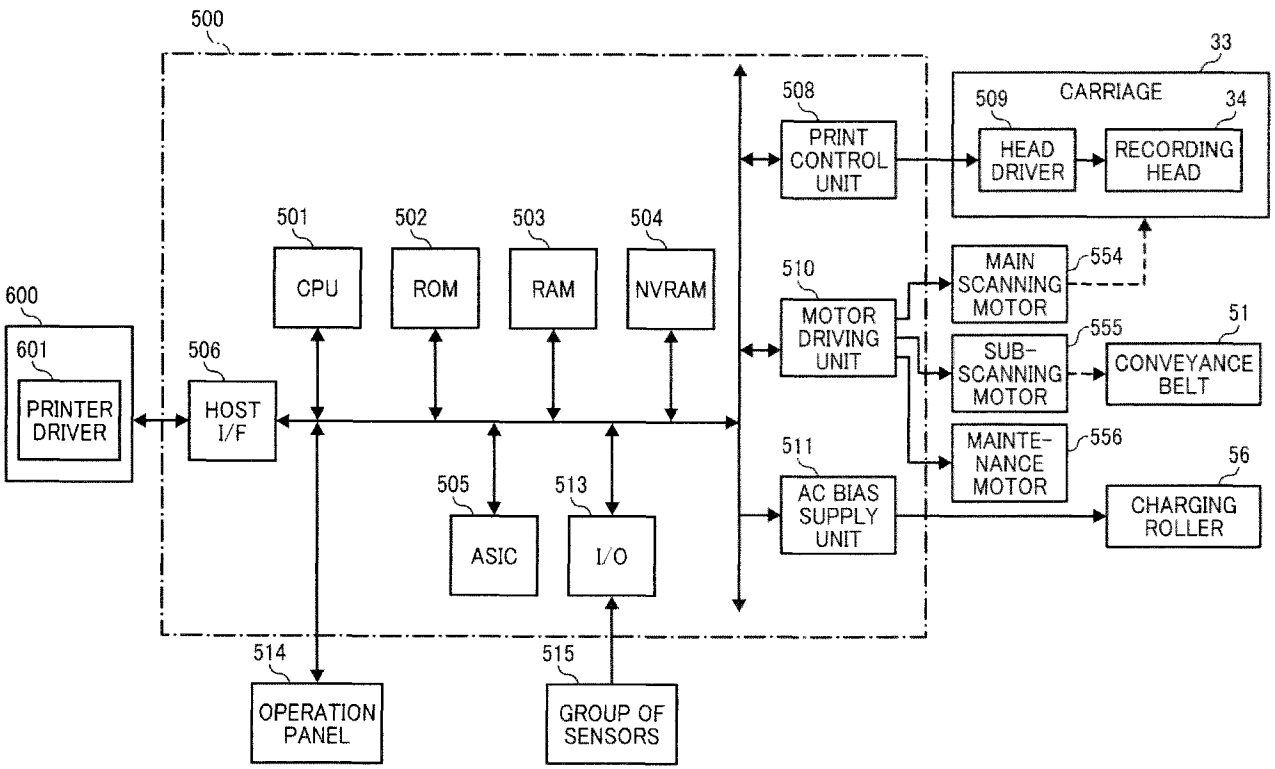
FIG. 6 is a block diagram of a controller of the image forming apparatus.

FIG. 6 is a block diagram of a controller 500 of the image forming apparatus.

The controller 500 includes a central processing unit (CPU) 511, a read-only memory (ROM) 502, a random access memory (RAM) 503, a non-volatile memory 504, and an application-specific integrated circuit (ASIC) 505. The CPU 511 manages the control of the entire image forming apparatus. The ROM 502 stores fixed data, such as programs executed by the CPU 511, and the RAM 503 temporarily stores image and other data. The non-volatile memory 504 is a rewritable memory capable of retaining data even when the apparatus is powered off The ASIC 505 processes various signals on image data, performs sorting or other image processing, and processes input and output signals to control the entire apparatus.

The controller 500 also includes a print control unit 508, a head driver (driver IC) 509, a main scanning motor 554, a sub-scanning motor 555, a motor driving unit 510, and an alternating current (AC) bias supply unit 511. The print control unit 508 includes a data transfer section and a driving signal generating section to drive and control the recording heads 34 (see FIG. 7). The head driver 509 is disposed at the carriage 33 to drive the recording heads 34. The main scanning motor 554 moves the carriage 33 for scanning, and the sub-scanning motor 555 circulates the conveyance roller 51. The motor driving unit 510 drives a maintenance motor 556 to move, e.g., the caps 82 and the wiping member 83 of the maintenance unit 81. The AC bias supply unit 511 supplies an AC bias to the charging roller 56.

The controller 500 is connected to an operation panel 514 for inputting and displaying information necessary to the image forming apparatus.

The controller 500 includes a host interface (I/F) 506 for transmitting and receiving data and signals to and from a host 600, such as an information processing device (e.g., personal computer), image reading device (e.g., image scanner), or imaging device (e.g., digital camera), via a cable or network.

The CPU 501 of the controller 500 reads and analyzes print data stored in a reception buffer of the I/F 506, performs desired image processing, data sorting, or other processing with the ASIC 505, and transfers image data to the head driver 509. It is to be noted that dot-pattern data for image output may be created by any of the controller 500 and a printer driver 601 of the host 600.

The print control unit 508 transfers the above-described image data as serial data and outputs to the head driver 509, for example, transfer clock signals, latch signals, and control signals required for the transfer of image data and determination of the transfer. In addition, the print control unit 508 has a driving signal generating section (see FIG. 7) including, e.g., a digital/analog (D/A) converter, a voltage amplifier, and a current amplifier, and outputs a driving signal containing one or more driving pulses to the head driver 509.

In accordance with serially-inputted image data corresponding to one image line recorded by the recording heads 34, the head driver 509 selects driving pulses of a driving waveform transmitted from the print control unit 508 and applies the selected driving pulses to the piezoelectric member 112 to drive the recording heads 34. Thus, the piezoelectric member 112 serving as the pressure generator generates energy to eject liquid droplets from the recording heads 34. At this time, by selecting a part or all of the driving pulses forming the driving waveform or a part or all of waveform elements forming a driving pulse, the recording heads 34 can selectively eject dots of different sizes, e.g., large droplets, middle droplets, and small droplets.

An input/output unit 513 obtains information from a group of sensors 515 mounted in the image forming apparatus, extracts information required for controlling printing operation, and controls the print control unit 508, the motor driving unit 510, and the AC bias supply unit 511 based on the extracted information. The group of sensors 515 includes, for example, an optical sensor to detect a position of the sheet, a thermistor to monitor temperature in the apparatus, a sensor to monitor the voltage of a charging belt, and an interlock switch to detect the opening and closing of a cover. The I/O unit 513 is capable of processing information from such various types of sensors.

Figure 7:
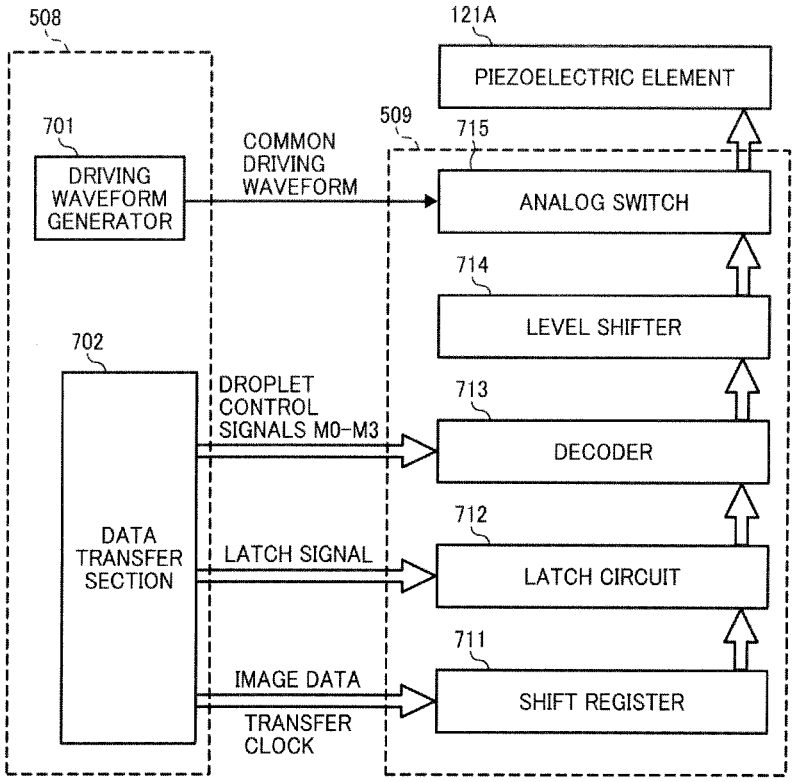
FIG. 7 is a block diagram of a print control unit of the controller and a head driver.

Next, an example of the print control unit 508 and the head driver 509 is described with reference to FIG. 7.

The print control unit 508 includes a driving waveform generator 701 serving as the driving signal generating section and a data transfer section 702 serving as the data transfer section. The driving waveform generator 701 generates and outputs a driving waveform (common driving waveform) containing a plurality of pulses (driving signals) within a single print cycle (driving cycle) in image formation. The data transfer section 702 outputs clock signals, latch signals (LAT), droplet control signals M0 to M3, and two-bit image data (gray-scale signals 0, 1) corresponding to print image.

The droplet control signals are two-bit signals for instructing the opening and closing of an analog switch 715 serving as a switching device of the head driver 109 in connection with each droplet. In synchronization with the print cycle of the common driving waveform, the droplet control signals change the state to a high (H) level (ON state) at a selected pulse or waveform element and to a low (L) level (OFF state) at a non-selected pulse or waveform element.

The head driver 509 includes a shift register 711, a latch circuit 712, a decoder 713, a level shifter 714, and the analog switch 715. The shift register 711 receives transfer clocks (shift clocks) and serial image data (gray-scale data: two bits/one channel, i.e., one nozzle) from the data transfer section 702. The latch circuit 712 latches values of the shift register 711 based on latch signals. The decoder 713 decodes gray-scale data and control signals M0 to M3 and outputs decoded results. The level shifter 714 shifts the level of logic-level voltage signals of the decoder 713 to a level at which the analog switch 715 is operable. The analog switch 715 is turned on/off (opened and closed) in response to the outputs of the decoder 713 transmitted via the level shifter 714.

The analog switch 715 is connected to a selection electrode (individual electrode) of each piezoelectric member 112 and receives a common driving waveform Pv from the driving waveform generator 701. When the analog switch 715 is turned on in response to a result obtained by decoding the serially-transferred image data (gray-scale data) and the droplet control signals M0 to M3 with the decoder 713, a desired pulse (or waveform element) of the common driving waveform Pv passes (is selected by) the analog switch 715 and is applied to the piezoelectric member 112.

Next, a driving waveform in a first exemplary embodiment of the present disclosure is described with reference to FIG. 8.

Figure 8:
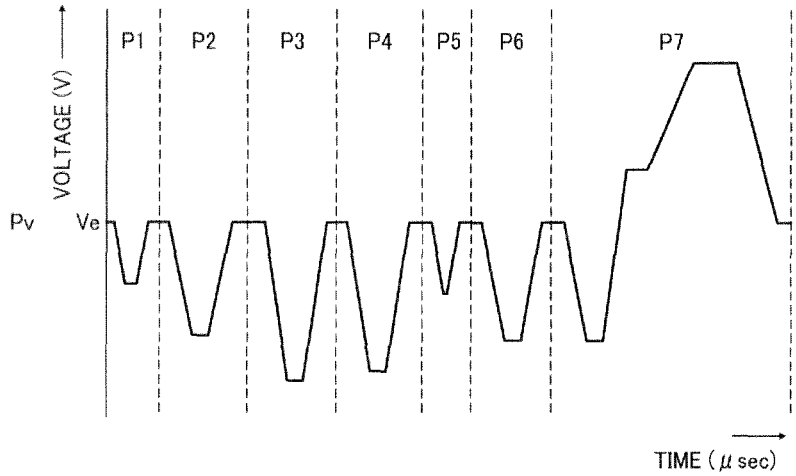
FIG. 8 is a diagram of a driving waveform in an exemplary embodiment of the present disclosure.

The driving waveform generator 701 outputs, for example, a driving waveform Pv (common driving waveform) illustrated in FIG. 8. The driving waveform Pv is a waveform formed by time-serially generating driving pulses P1 to P7 in a single print cycle (single driving cycle) in synchronization with a reference signal. The reference signal is a signal output corresponding to the position of the carriage 33 in the main scanning direction in accordance with the density of an image to be formed.

Here, a large droplet is created with all of the driving pulses P1 to P7. A middle droplet is created with the driving pulses P5 to P7, and a small droplet is created with the driving pulse P7. In other words, all sizes of droplets are created with at least the driving pulse P7. To form a single dot on a recording medium by sequentially ejecting multiple liquid droplets through application of a plurality of driving pulses, the liquid droplets need merge into a single droplet or land on the same position on the recording medium. Accordingly, the speed of liquid droplets need gradually increase to cause a following droplet to catch up with a preceding droplet. To merge liquid droplets during flying, the speed of a liquid droplet ejected by the last driving pulse need be faster than any of the speeds of precedently ejected droplets.

Figure 9:
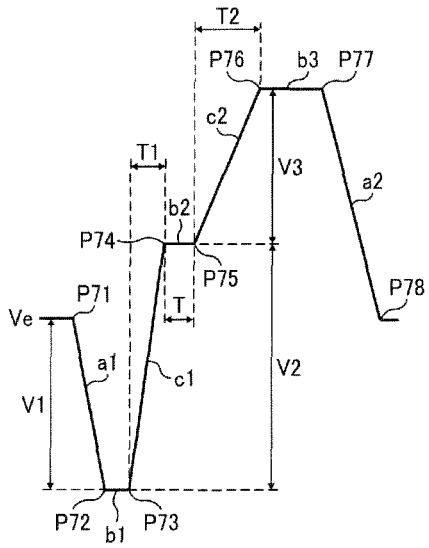
FIG. 9 is an enlarged diagram of a last driving pulse of the driving waveform.

Here, the pulse shape of the driving pulse P7, i.e., the last pulse of the driving waveform Pv is described with reference to FIG. 9.

The driving pulse P7 is a waveform formed by successively generating in time series a first expansion waveform element a1, a first retaining waveform element b1, a first contraction waveform element c1, a second retaining waveform element b2, a second contraction waveform element c2, a third retaining waveform element b3, and a second expansion waveform element a2. The first expansion waveform element a1 (points P71 to P72: first expansion step) drops from the reference potential Ve to expand the liquid chamber 106. The first retaining waveform element b1 (points P72 to P73: first retaining step) retains a first expanded state of the liquid chamber 106 created by the first expansion waveform element a1. The first contraction waveform element c1 (points P73 to P74: first contraction step) contracts the liquid chamber 106 from the first expanded state retained by the first retaining waveform element b1 to eject a liquid droplet from the nozzle 104. The second retaining waveform element b2 (points P74 to P75: second retaining step) retains a first contracted state of the liquid chamber 106 created by the first contraction waveform element c1. The second contraction waveform element c2 (points P75 to P76: second contraction step) further contracts the liquid chamber 106 from the first contracted state retained by the second retaining waveform element b2. The third retaining waveform element b3 (points P76 to P77: third retaining step) retains a second contracted state of the liquid chamber 106 created by the second contraction waveform element c2. The second expansion waveform element a2 (points P77 to P78: second expansion step) expands the liquid chamber 106 from the second contracted state retained by the third retaining waveform element b3 to a state prior to the application of the first expansion waveform element a1.

The first expansion waveform element a1 has a potential difference V1 smaller than a potential difference V2 of the first contraction waveform element c1 (V1<V2), and the first contraction waveform element c1 has a time period T1 shorter than a time period T2 of the second contraction waveform element c2 (T1<T2).

In other words, in an equilibrium state, i.e., a position of the reference potential (intermediate potential) Ve after the end of the driving pulse P6, when the first expansion waveform element a1 is applied, the liquid chamber 106 expands. In addition, when the first retaining waveform element b1 is applied, the first expanded state of the liquid chamber 106 created by application of the first expansion waveform element a1 is retained. Further, when the first contraction waveform element c1 is applied, the liquid chamber 106 contracts, thus instantly increasing the internal pressure of the liquid chamber 106. Then, the first contracted state of the liquid chamber 106 created by the first contraction waveform element c1 is retained by application of the second retaining waveform element b2, and the second contraction waveform element c2 having a rising constant smaller than the first contraction waveform element c1 is applied. As a result, the liquid chamber 106 relatively slowly contracts, and the second contracted state created by the second contraction waveform element c2 is retained by the third retaining waveform element b3. Finally, the second expansion waveform element a2 is applied to return the volume of the liquid chamber 106 to the original state of the reference potential Ve (i.e., expands the liquid chamber 106 from the second contracted state).

At this time, since the potential difference V2 of the first contraction waveform element c1 is greater than the potential difference V1 of the first expansion waveform element a1 (V1<V2), the diaphragm member 2 is pushed to a position closer to the nozzle 104 than a position (initial position) of the diaphragm member 2 applied with the reference potential Ve. As a result, in ejecting a large or middle droplet, a liquid droplet is ejected at a speed higher than a liquid droplet ejected by the driving pulse P6. Thus, the liquid droplet ejected by the driving pulse P6 and the liquid droplet ejected by the driving pulse P7 merge during flying to land on the recording medium as a single dot.

The time period T2 (between the points P75 and P76) of the second contraction waveform element c2 is longer than the time period T1 (between the points P73 and P74) of the first contraction waveform element c1 (T1<T2). In this exemplary embodiment, for example, the time period T2 of the second contraction waveform element c2 is set to be twice as long as the time period T1 of the first contraction waveform element c1.

Thus, the droplet speed of a main droplet, i.e., a leading droplet of a liquid droplet ejected by the first contraction waveform element c1 is determined. Then, after the first contracted state is retained by the second retaining waveform element b2 for a certain time, the internal pressure of the liquid chamber 106 is slowly raised by the second contraction waveform element c2 having a relatively small rising constant. Thus, the speed of only a droplet (satellite droplet) following the main droplet can be increased without affecting the main droplet ejected by the first contraction waveform element c1.

A total (T2+T) of the time period T of the second retaining waveform element b2 (between the points P74 and P75) and the time period T2 of the second contraction waveform element c2 (between the points P75 and P76) is set to have a relation of Tc×3/4<T2+T<Tc, where Tc represents natural resonance cycle of the liquid chamber 106. As a result, when the internal pressure of the liquid chamber 106 reduced by the droplet ejection of the first contraction waveform element c1 is raised by a vibration of the natural resonance cycle Tc, the second contraction waveform element c2 can be applied, thus allowing the speed-up (acceleration) of the satellite droplet.

As a result, a meniscus of liquid in the nozzle 104 is pushed outward at the end of the second contraction waveform element c2, thus allowing the satellite droplet to be easily separated from the meniscus of the nozzle 104.

The time period from the start point P73 of the first contraction waveform element c1 to the end point P77 of the third retaining waveform element b3 (the start point of the second expansion waveform element a2) is set to be double the natural resonance cycle Tc.

As a result, a displacement having a phase opposite a phase of the vibration of the meniscus is applied, thus allowing the vibration of the meniscus to be efficiently minimized after the satellite droplet is ejected from the nozzle 104.

Thus, since the droplet speed of the satellite droplet or the moving speed of the satellite is higher than the main droplet, the satellite droplet or the satellite catches up with and merges (is absorbed) into the main droplet during flying. On landing on the recording medium, the satellite droplet or the satellite disappears, and the liquid droplet landed on the medium has a substantially round shape.

Finally, the second expansion waveform element a2 is applied for a longer time than the first expansion waveform element a1 to relatively slowly return the liquid chamber 106 to the original volume. The time period of the second expansion waveform element a2 is preferably within a range from half of a length of the natural resonance cycle Tc of the liquid chamber 106 to the length of the natural resonance cycle Tc the liquid chamber 106. Thus, fluctuations in the internal pressure of the liquid chamber 106 after droplet ejection can be minimized. As a result, even when another driving waveform for a subsequent ejection is applied, the above-described driving waveform can minimize influence of the fluctuations on the subsequent ejection.

The voltage V2 of the first contraction waveform element c1 is set to be greater than the voltage V1 of the first expansion waveform element a1, and the voltage V3 of the second contraction waveform element c2 has a potential difference not less than half of the voltage V2 of the first contraction waveform element c1. Thus, the satellite droplet or the satellite can be sufficiently sped up, allowing he satellite droplet or the satellite to be absorbed into the main droplet before the main droplet arrives at the recording medium.

As described above, in this exemplary embodiment, the driving pulse P7 is the last applied one of the plurality of driving pulses. In other words, whenever a large or middle-sized droplet is ejected, the driving pulse P7 is used as the last one of driving pulses. As a result, when a large droplet is formed by sequentially applying a plurality of driving pulses and merging a plurality of liquid droplets into a single droplet, the length of satellite or satellite droplet can be shortened.

Next, droplet ejection from the nozzle 104 at the application of the driving pulse P7 is described with reference to FIGS. 10A to 10G.

FIGS. 10A to 10G show states of the nozzle 104 and its surrounding area at the points P71 to P78, respectively.

Figures 10A, 10B, 10C, 10D, 10E, 10F, 10G:
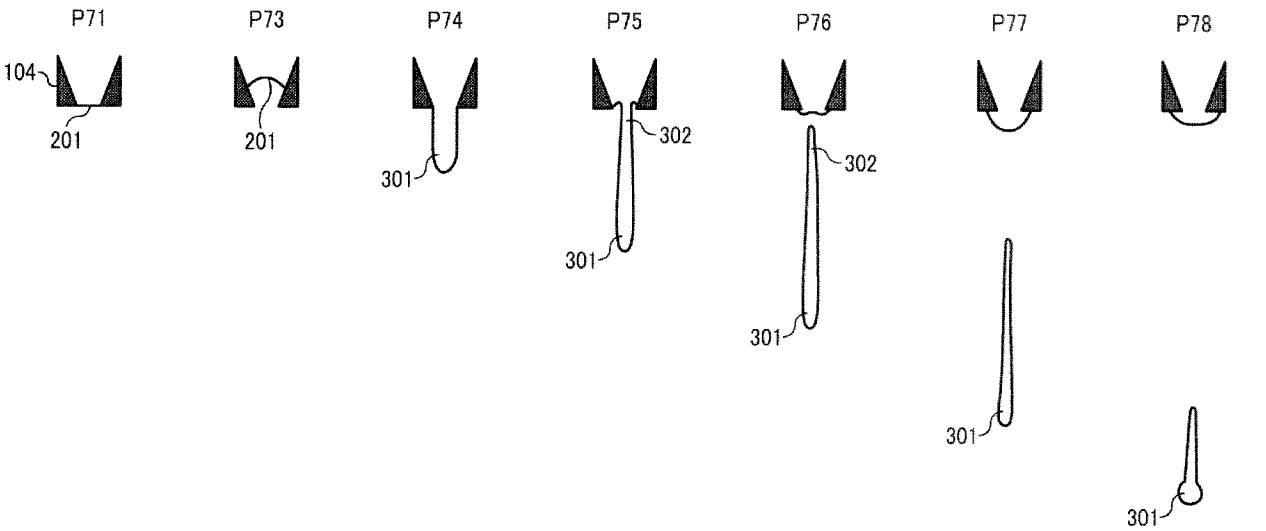
FIGS. 10A to 10G are schematic views of droplet ejection from a nozzle at the application of the last driving pulse of FIG. 9.

As illustrated in FIG. 10A, a meniscus 201 of liquid in the nozzle 104 is in equilibrium state at the point P71 before the application of the first expansion waveform element a1. From the state of FIG. 10A, when the first expansion waveform element a1 is applied, as illustrated in FIG. 10B, the meniscus 201 is pulled into the liquid chamber 106. When the first contraction waveform element c1 is applied, as illustrated in FIG. 10C, a liquid droplet 301 is ejected from the nozzle 104 at the point P74. Then, as illustrated in FIG. 10D, from the point P75, i.e., the end point of the application of the second retaining waveform element b2, the second contraction waveform element c2 of the voltage V3 is applied to further contract the liquid chamber 106. At this time, the voltage V3 applied at P75 does not affect a leading portion of the liquid droplet 301 ejected at the point P74 but affects only a droplet portion 302 adjacent to the nozzle 104, thus acting in such a direction as to speed up the droplet portion 302. As a result, as illustrated in FIGS. 10E to 10G, the droplet portion 302 (rear end portion of the liquid droplet 301) separates from the meniscus 201 and gradually catches up with the leading portion of the liquid droplet 301. FIGS. 10E to 10G show a case where the satellite does not separate as another droplet. It is to be noted that, even in a case where the satellite separates from the leading portion (main droplet) of the liquid droplet 301 as a satellite droplet, the voltage V3 affects only the satellite droplet to speed up the satellite droplet, thus allowing the satellite droplet to catch up with the main droplet.

Figure 11:
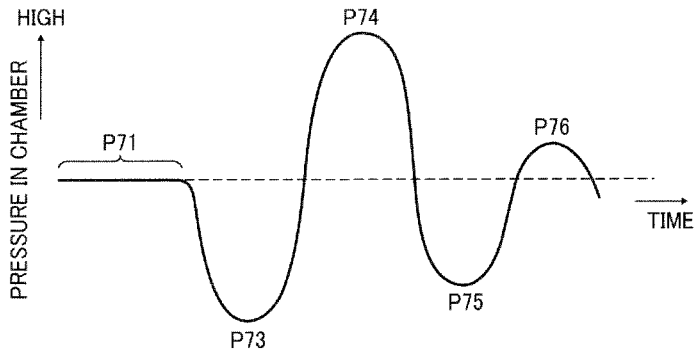
FIG. 11 is a chart of relations between ejection states of FIGS. 10A to 10G and fluctuations in internal pressure of a liquid chamber caused by the driving pulse of FIG. 9.

Next, relations between the ejection states of FIGS. 10A to 10G and fluctuations in the internal pressure of the liquid chamber 106 caused by the driving pulse P7 are described with reference to FIG. 11.

From the equilibrium state at the point P71, the internal pressure of the liquid chamber 106 reaches a maximum negative pressure at the point P73 via the first expansion step of the first expansion waveform element a1 and the first retaining step of the first retaining waveform element b1. Then, at the point P74, the internal pressure reaches a maximum positive pressure via the first contraction step of the first contraction waveform element c1. At the point P75, the internal pressure decreases during the second retaining step of the second retaining waveform element b2. However, the internal pressure starts to rise again due to the vibration of natural resonance cycle. At this time, by applying the second contraction waveform element c2, pressure is applied to a rear end portion (satellite) of a liquid droplet. As a result, the speed of the rear end portion becomes higher than a leading portion of the liquid droplet.

Figure 12:
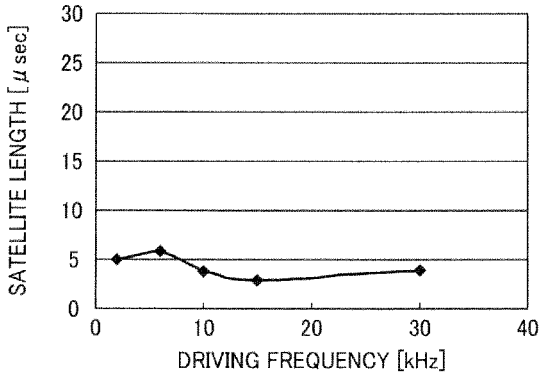
FIG. 12 is a chart of results of measurements in which the satellite length of large droplets created by the driving pulse of FIG. 9 is measured at different driving frequencies.

FIG. 12 shows results of measurements in which the satellite length of large droplet created by the driving pulse in this exemplary embodiment is measured at different driving frequencies. The results show that the satellite length is stably maintained from a low frequency area to a high frequency area. In particular, the results indicate that the driving waveform in this exemplary embodiment can significantly reduce the length of satellite in the low frequency area.

Figure 13:
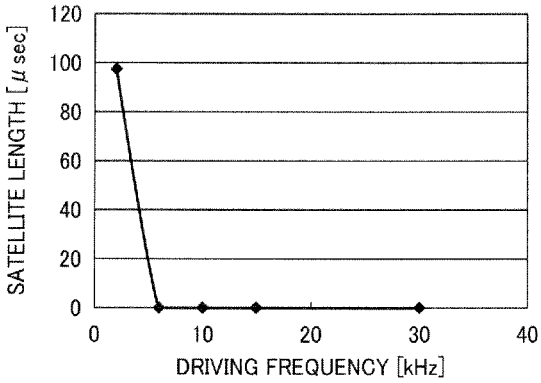
FIG. 13 is a chart of results of measurements in which the satellite length of large droplets created by a driving pulse of a comparative example is measured at different driving frequencies.
Figure 14:
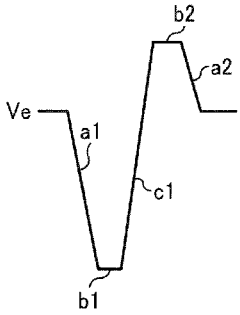
FIG. 14 is a diagram of the driving pulse of the comparative example.

By contrast, FIG. 13 shows results of measurements in which the satellite length of large droplet created by a driving pulse of a comparative example illustrated in FIG. 14 is measured at different driving frequencies. The driving pulse of FIG. 4 differs from the driving pulse in this exemplary embodiment in that the driving pulse of FIG. 4 does not include the second contraction waveform element c2 and the third retaining waveform element b3. The results indicate that for the driving waveform in the comparative example of FIG. 14, the satellite length quite increases in the low frequency area. This indicates that, when liquid droplets are ejected so as not to overlap with each other on a recording medium, droplets (satellite droplets) differing from the main droplets also land on the recording medium to blur the boundary of, e.g., characters or lines. In other words, since a liquid droplet is ejected by application of the first contraction waveform element c1 and flies without application of another contraction waveform element, the shape of the liquid droplet is elongated, thus increasing the satellite length.

The "satellite length" used herein represents a time period from when the main droplet, i.e., the leading portion of the liquid droplet arrives at the recording medium to when a tail end of the satellite following the main droplet arrives at the recording medium. The liquid droplet is likely to have a round shape by its surface tension during flying. However, if the satellite is long and flies at low speed, the liquid droplet arrives at the recording medium before forming a round shape, thus hampering formation of a circular dot on the recording medium. As the distance (print gap) between the nozzle and the recording medium increases, the liquid droplet is likely to land on the recording medium after forming a round shape. However, such an increased print gap is likely to reduce the accuracy of landing position of the liquid droplet. Hence, by reducing the satellite length with the driving waveform in this exemplary embodiment, the time required for the liquid droplet to form a round shape and the print gap can be shortened.

In the above-described exemplary embodiment, the image forming apparatus is described as a serial-type image forming apparatus. However, it is to be noted that the image forming apparatus is not limited to the serial-type image forming apparatus and may be, e.g., a line-head-type image forming apparatus.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head having a nozzle to eject a droplet of a liquid, a liquid chamber communicating with the nozzle, and a pressure generator to generate a pressure to pressurize the liquid in the liquid chamber; and a driving waveform generator connected to the pressure generator to generate and output a driving waveform including a plurality of driving pulses per driving cycle to eject the droplet from the nozzle, a last one of the plurality of driving pulses including a first expansion waveform element to expand the liquid chamber, a first retaining waveform element to retain a first expanded state of the liquid chamber created by the first expansion waveform element, a first contraction waveform element to contract the liquid chamber from the first expanded state of the liquid chamber retained by the first contraction waveform element to eject the droplet from the nozzle, a second retaining waveform element to retain a first contracted state of the liquid chamber created by the first contraction waveform element, a second contraction waveform element to further contract the liquid chamber from the first contracted state of the liquid chamber retained by the second retaining waveform element, a third retaining waveform element to retain a second contracted state of the liquid chamber created by the second contraction waveform element, and a second expansion waveform element to expand the liquid chamber from the second contracted state retained by the third retaining waveform element to a state prior to application of the first expansion waveform element, the first contraction waveform element having a potential difference greater than a potential difference of the first expansion waveform element, the second contraction waveform element having a time period longer than a time period of the first contraction waveform element.

2. The image forming apparatus of claim 1, wherein the time period of the second contraction waveform element is twice as long as the time period of the first contraction waveform element.

3. The image forming apparatus of claim 1, wherein the second expansion waveform element has a time period longer than a time period of the first expansion waveform element.

4. The image forming apparatus of claim 1, wherein the second expansion waveform element has a time period in a range from half a length of a natural resonance cycle of the liquid chamber to the length of the natural resonance cycle of the liquid chamber.

5. The image forming apparatus of claim 1, wherein a total of a time period of the second retaining waveform element and the time period of the second contraction waveform element is within a range from three fourths of a length of a natural resonance cycle of the liquid chamber to the length of the natural resonance cycle of the liquid chamber.

6. The image forming apparatus of claim 1, wherein a time period from a start of the first contraction waveform element to a start of the second expansion waveform element is twice as long as a length of a natural resonance cycle of the liquid chamber.

7. The image forming apparatus of claim 1, wherein the second contraction waveform element has a potential difference not less than half of the potential difference of the first contraction waveform element.

* * * * *